United States Patent [19]

Talarico

[11] 4,199,069

[45] Apr. 22, 1980

[54] RACK

[76] Inventor: Joe Talarico, 3726 St-Ambroise, Montreal, Canada, H4C 2C5

[21] Appl. No.: 651,201

[22] Filed: Jan. 21, 1976

[51] Int. Cl.[2] ..... A47F 5/00

[52] U.S. Cl. ..... 211/194; 108/535; 108/55.1; 211/189

[58] Field of Search ..... 211/189, 191, 194; 108/55 R, 53 B, 56 R; 214/10.5 R; 220/6

[56] References Cited

U.S. PATENT DOCUMENTS

| | | | |
|---|---|---|---|
| Re. 24,493 | 6/1958 | Phillips | 220/6 |
| 1,490,665 | 4/1924 | Gifford | 108/53 B |
| 2,669,373 | 2/1954 | Coit | 108/55 R X |
| 2,917,261 | 12/1959 | Stough | 108/55 R |
| 2,988,313 | 6/1961 | Ellison | 108/53 B |
| 3,168,060 | 2/1965 | Farley | 108/53 B |
| 3,224,388 | 12/1965 | Skubic | 108/53 B |
| 3,348,723 | 10/1967 | Wilson | 220/6 |
| 3,565,018 | 4/1969 | Jay | 108/55 R X |
| 3,883,026 | 5/1975 | Selz | 220/6 |
| 3,945,497 | 3/1976 | Greenberg | 108/53 B X |

FOREIGN PATENT DOCUMENTS

| | | | |
|---|---|---|---|
| 1026237 | 3/1958 | Fed. Rep. of Germany | 211/189 |
| 1144178 | 2/1963 | Fed. Rep. of Germany | 220/6 |
| 1227059 | 8/1960 | France | 220/6 |
| 459883 | 9/1968 | Switzerland | 108/53 B |
| 956882 | 4/1964 | United Kingdom | 220/6 |
| 1299219 | 12/1972 | United Kingdom | 108/53 B |

*Primary Examiner*—Ramon S. Britts
*Assistant Examiner*—Robert W. Gibson, Jr.
*Attorney, Agent, or Firm*—Raymond A. Robic; Francis B. Francois

[57] ABSTRACT

A carrying rack having a quadrangular support base with support legs at the corners. Vertical support posts are detachably mounted to the support legs at the corners of the base and two cross-pieces are provided, one detachably mounted on two of the posts, and the other detachably mounted on the other two posts. The cross-pieces slide down the posts to rest on the load carried between the posts. The rack can also include a set of sidewalls and endwalls for replacing the set of posts and cross-pieces. The sidewalls each comprise two posts joined by panel means. Each sidewall is detachably mounted on the base with its posts inserted into two legs on the base. Each endwall has a cross-piece and panel means depending down from it. The cross-piece is mounted on opposed posts of the sidewalls. The rack can also be provided only with the above sidewalls and endwalls.

4 Claims, 8 Drawing Figures

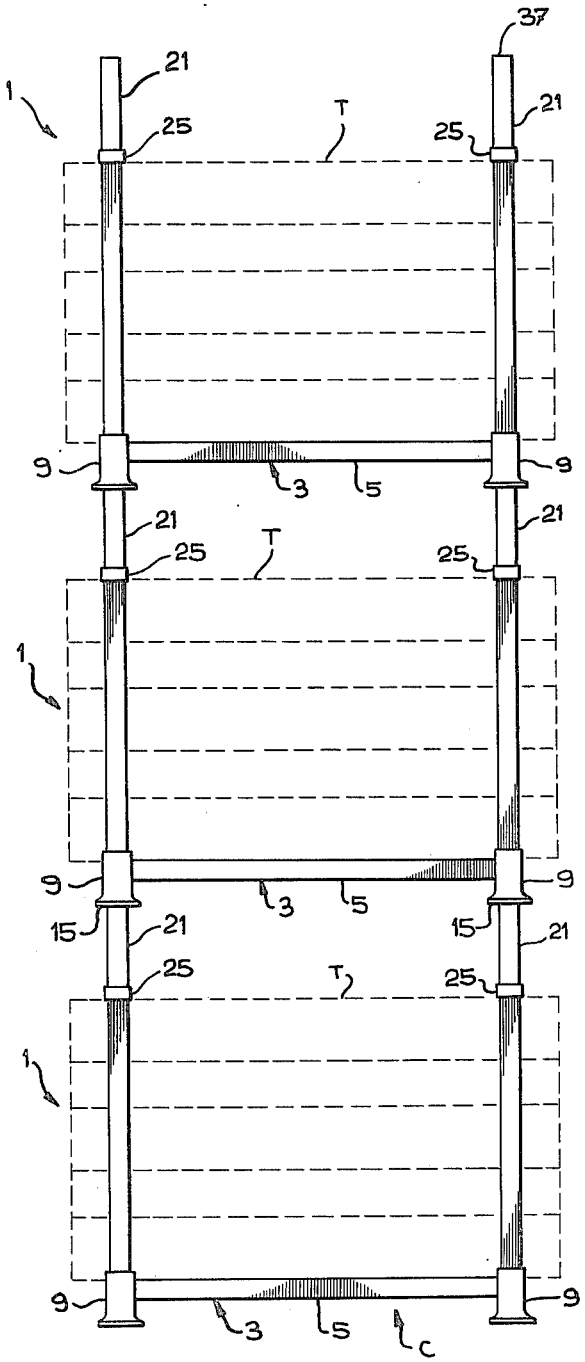
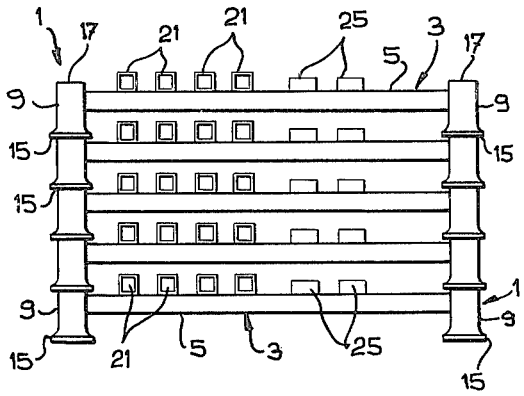
FIG. 5
FIG. 4

RACK

This invention is directed toward an improved carrying rack.

The invention is more particularly directed toward an improved carrying rack of the knock-down and stackable type.

Carrying racks, or pallets, of the knock-down and stackable type are already known as shown in U.S. Pat. Nos. 963,030; 2,994,500; 3,159,116; 3,187,901; 3,411,634; 3,500,770; 3,502,227; 3,536,016; 3,765,541 and 3,857,494. These known racks employ a superstructure mounted on the base of the rack or pallet whereby the loaded racks or pallets can be safely stacked one on top of the other.

In U.S. Pat. No. 963,030 the vertical members and their interconnecting horizontal members are all separate, so that the device can be broken down for easy carrying. Thus, there is no rigid base member by which the superstructure can be lifted and moved about.

The rack of U.S. Pat. No. 3,187,901 does show a rigid base member, to which end members are attached. But no provision is made for interconnecting the end members, and the latter are not adjustable to accommodate different kinds of loads.

In U.S. Pat. Nos. 3,502,227 and 3,765,541, racks are shown utilizing a rigid base member having four legs secured thereto. Each unit is stackable on another unit, to reach a desired height. It is not contemplated that the leg members be removable from the base member for easy storage, and no provision is made for securing loads carried by the racks.

The superstructures in U.S. Pat. Nos. 2,994,500, 3,159,116 and 3,500,770 all utilize a wooden pallet of conventional construction, and require special brackets to secure the upright members thereto. The resultant structure is relatively complicated in each instance, and disassembly and reassembly is thus somewhat involved.

The rack of U.S. Pat. No. 3,857,494 shows a rigid base with upright members, and includes channel members on the uprights for slidably receiving boards therebetween. The structure is fairly complicated and somewhat difficult to manufacture, and thus is not economically suited to many use situations.

Finally, U.S. Pat. Nos. 3,411,634 and 3,536,016 show rigid base members to which upright end frames are attached, the end frames then having tray-like members connected to extend therebetween. While well suited to certain uses, the racks of these patents do not offer the open construction required for many other uses.

The known racks of these patents possess disadvantages for general use, in most instances. For example, some thereof are relatively complicated in structure, and expensive. Where the known racks employ a wooden pallet base, special fittings are required for mounting the stacking superstructure. With these fittings it can be quite a time consuming operation to assemble or disassemble the rack. In addition, the superstructure does not always disassemble into simple, easily and minimally stored elements.

It is therefore a purpose of the present invention to provide an improved carrying rack which is extremely simple in construction; which is easily assembled or disassembled; and which takes up a minimum of storage space when disassembled.

It is a fruther purpose of the present invention to provide simple, and easily mountable, cross-piece strucutre in the superstructure portion of the rack. The novel cross-piece structure strengthens the superstructure portion and also aids in retaining a load in the rack by resting directly on the load.

It is another purpose of the present invention to provide an improved carrying rack of the knock-down and stackable type which has sidewalls and endwalls in the superstructure portion to provide a bin-type rack.

It is a still further purpose of the present invention to provide an improved carrying rack which, with few additional simple pieces can be employed as either a post-type, or bin-type, knock-down, stackable rack.

The invention, in the broadest sense, is directed toward a carrying rack having a quadrangular support base with a vertical support leg at each corner of the base. The rack has a vertical support post at each corner, and means for detachably mounting each post to the leg at each corner. The rack includes at least one cross-piece detachably mounted on two of the posts.

Preferably, the rack has two cross-pieces with one cross-piece detachably mounted on two of the support posts and with the other cross-piece detachably mounted on the other two of the support posts, the two cross-pieces being substantially parallel.

Each cross-piece has means at each end for at least partly, and preferably completely, encircling a post so that the cross-pieces can be slidably mounted on the posts.

The rack can include a set of separate, detachably mountable, sidewalls and endwalls. Each sidewall comprises a pair of vertical support posts and panel means extending between the pair of posts. Each endwall comprises a cross-piece and panel means depending down from the cross-piece. The cross-piece has means at its ends for detachably mounting the endwall on opposing posts forming part of the sidewalls. The sidewalls are each mounted on the base with their two posts inserted into two legs on the base, and are parallel to one another.

The rack, equipped with both a set of posts and cross-pieces, and a set of sidewalls and endwalls, can be used to carry many types of loads. Using the set of posts and cross-pieces, the rack can carry elongated objects, such as tubes, piled in a regular fashion between the posts and maintained between the posts by the cross-pieces mounted on the posts and bearing on the objects. Using instead the set of sidewalls and endwalls the rack becomes a bin capable of carrying randomly piled objects.

In accordance with the present invention, the carrying rack may be provided with the set of sidewalls and endwalls only.

The invention will now be described in detail having reference to the accompanying drawings in which:

FIG. 4 is a front elevation view of a stack of racks, each loaded with tubes;

FIG. 5 is a front elevation view of a stack of disassembled racks;

Figure 1:
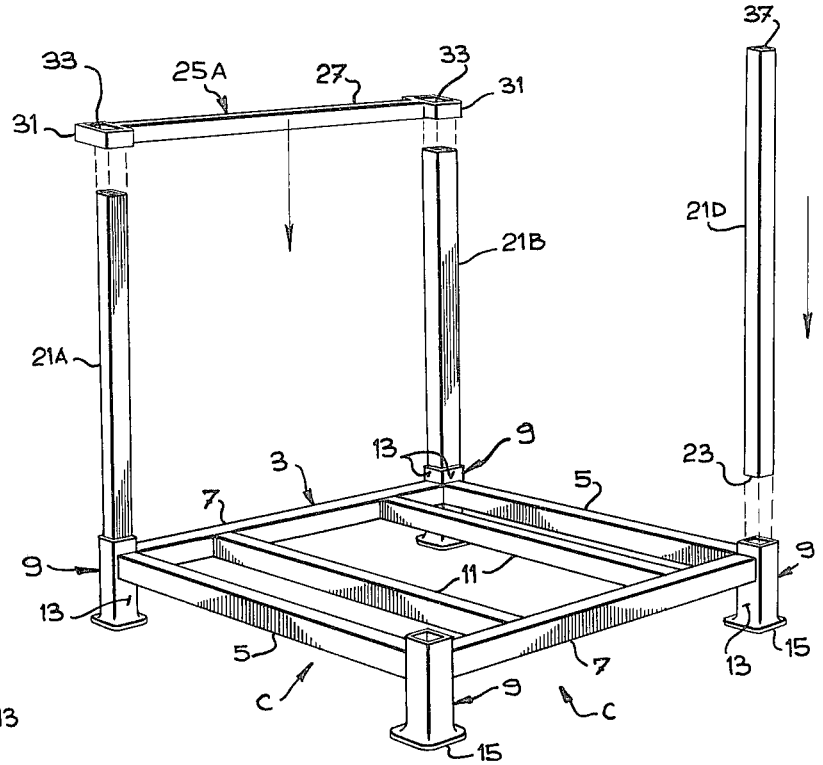
FIG. 1 is a perspective view of the carrying rack of the present invention employing posts.
Figure 2:
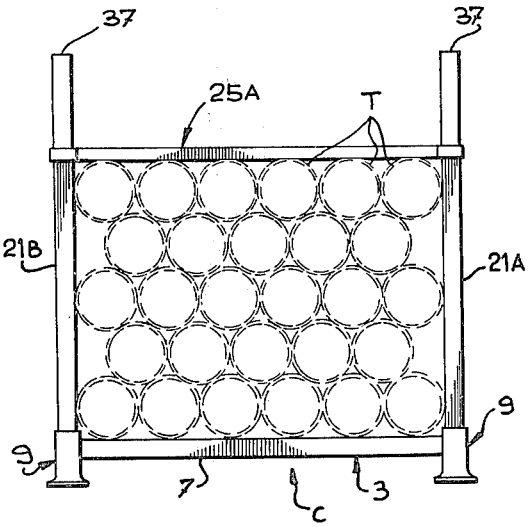
FIG. 2 is an end elevation view of the rack loaded with tubes.
Figure 3:
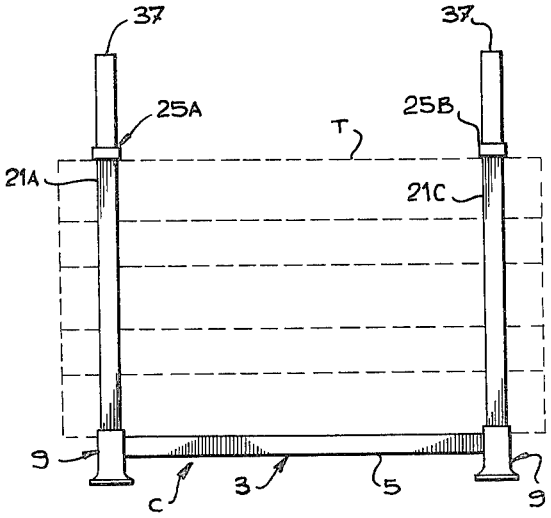
FIG. 3 is a front elevation view of the rack loaded with tubes.

As shown in FIGS. 1 to 3, the carrying rack 1 of the present invention has a quadrangular support base 3. The support base 3 may be either square or rectangular in shape, and has two side support members 5 and two end support members 7. The side and end support members 5, 7 are joined together to provide the quadrangular shape of the base by relatively short, vertical, support legs 9 located at the corners of the base 3. An additional pair of transverse support members 11 may be provided in the base 3 extending between end members 7, and parallel to, but spaced from side members 5. The support members 5, 7 and 11 are preferably made from straight, square, tubular, stock.

Figure 1A:
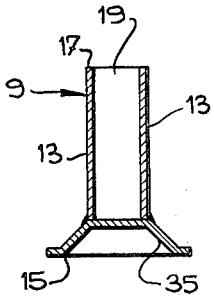
FIG. 1A is a detail, cross-sectional view of a support leg of the carrying rack.

The support legs 9 also preferably have a square cross-section thereby providing sidewalls 13 at right angles to one another to which sidewalls the side and end support members 5, 7 are attached. The support members 5, 7 are preferably attached to legs 9 a distance above the base 15 of the legs to provide clearance "C" for the arms of a fork lift truck to transport the rack. The base 15 of the support legs 9 can, if desired, be enlarged to provide more stability. The top 17 of each leg 9 preferably has an upwardly opening socket 19 as shown in FIG. 1A. Base 15 may be welded as shown in FIG. 1A or otherwise rigidly connected to leg 9.

Detachably mountable, vertical corner posts 21 are provided with the rack. One end 23 of each post 21 is adapted to be connected to each leg 9. Preferably, the end 23 of each post is adapted to be slidably inserted, into a socket 19 in a leg 9. The posts 21 are also preferably made from straight, square, tubular stock and the sockets 19 have a square cross-section sized to snugly receive the posts 21.

The rack 1 also includes at least one, and preferably a pair of detachably mountable cross-pieces 25. Each cross-piece 25 comprises a main, elongated body 27 with means at each end of body 27 for slidably mounting the cross-piece 25 onto a pair of posts 21. Thus, one cross-piece 25A joins two posts 21A, 21B together, and the other cross-piece 25B joins the other two posts 21C, 21D together. The slidable mounting means at each end of body 27 of cross-piece 25 can comprise a part or full post encircling portion, such as a square ring 31 having an opening 33 sized to just fit over the square posts 21. The posts 21 and cross-pieces 25 form the superstructure portion of the rack.

In use, the rack 1 is assembled by inserting posts 21 into sockets 19 is legs 9. The rack 1 is than loaded, with tubular members "T" for example, extending transverse to end support members 7 and between posts 21A, 21C at one side of the rack and posts 21B, 21D at the other side of the rack. The tubular members "T" are longer than the rack 1. Cross-pieces 25A, 25B are then slidably mounted on posts 21A, 21B and 21C, 21D respectively to extend across, and rest on, tubular members "T" thus pushing them down and retaining them in place when the loaded rack is transported. In addition, the cross-piece tie the posts together to provide a stronger rack capable of being stacked, when loaded, as will be described.

The legs 9 of the base 3 preferably also have downwardly opening sockets 35 in base 15 as shown in FIG. 1A. Sockets 35 have a trapezoidal form with a cross-sectional size and shape larger than sockets 19 and therefore posts 21, but substantially the same as legs 9. The sockets 35 therefore receive with some clearance the top ends 37 of the posts 21 of another rack 1 when the racks are stacked one on top of the other as shown in FIG. 4. Sockets 35 help retain the stacked racks in position.

When the racks 1 are not being used, they are disassembled with posts 21 and cross-pieces 25 laid across support members 5, 11. The disassembled racks 1 can be stacked one on top of the other as shown in FIG. 5, for compact storage or transport with the top 17 of the legs 9 of one rack supporting the base 15 of the legs 9 of the adjacent top rack. As above indicated, sockets 35 are sized to snugly receive the top 17 of the legs 9 of the adjacent bottom rack 1 when the racks are stacked so as to prevent their movement relative to one another when being transported.

Figure 6:
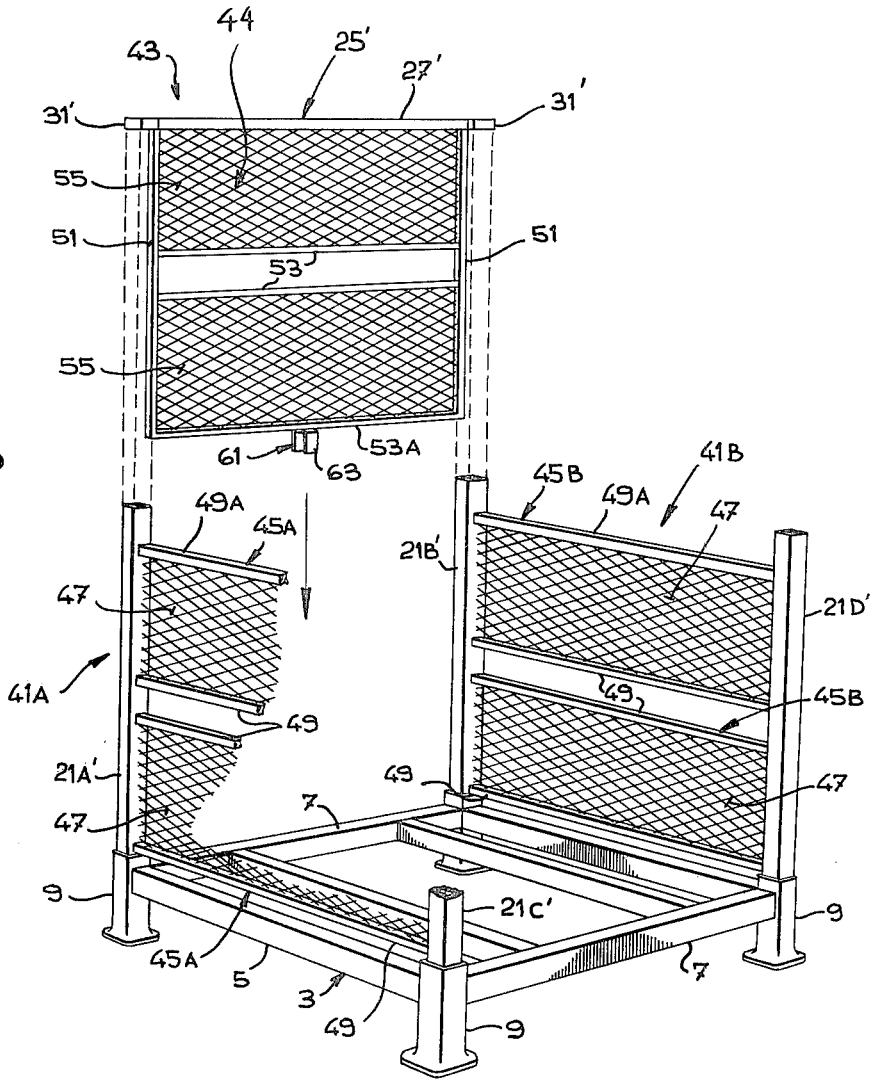
FIG. 6 is a perspective view of the carrying rack equipped with sidewalls.

If desired, the rack 1 can also be provided with a set of detachably mounted sidewalls 41 and endwalls 43. As shown in FIG. 6 posts 21A', 21C' can be joined by wall panels 45A and posts 21B', 21D' joined by wall panels 45B. The wall panels 45 can comprise wire mesh 47 fixed to the posts 21' and to horizontal mesh supports 49 themselves fixed to posts 21'. Posts 21A', 21C' and wall panels 45A form one detachably mountable sidewall 41A and posts 21B', 21D' and wall panels 45B form a second detachably mountable sidewall 41B.

Each endwall 43 (in FIG. 6 only one being shown) can comprise a pair of vertical wire mesh supports 51 fixed to, and extending down from, the main body 27' of a cross-piece 25'. Supports 51 are adjacent rings 31' on cross-piece 25'. Horizontal mesh supports 53 extend between vertical supports 51 and wire mesh 55 is fixed to the vertical and horizontal mesh supports 53 and also to main body 27' of cross-piece 25' thus forming a wall panel 44.

Means 61 are provided at the bottom of the endwalls 43 for helping to retain the end walls in position. These retaining means 61 can comprise a U-shaped bracket 63 mounted in the center of, and on the bottom of, bottom horizontal mesh support 53A. Bracket 63 is adapted to slide over an end support 7 when the cross-piece 25' is slidably mounted on posts 21'. When an endwall 43 is mounted on the base 3, its cross-piece 25' is slidably mounted over posts 21' and the cross-piece 25' slides down to rest on the top mesh supports 49A forming part of sidewalls 41A, 41B. The vertical mesh supports 51 of each endwall 43 lie closely adjacent the posts 21' forming part of the sidewalls 41A, 41B.

Figure 7:
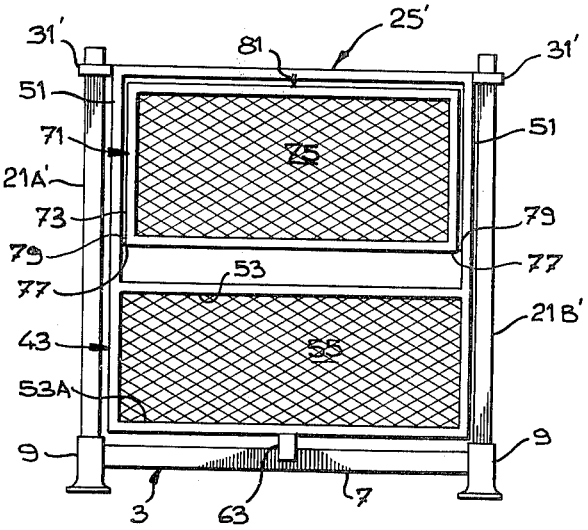
FIG. 7 is an elevation view of the rack shown in FIG. 6, modified with one side wall provided with a hinged portion.

If desired, one or both endwalls 43 can have a hinged wall portion 71 providing aide access into the bin. As shown in FIG. 7, the hinged wall portion 71 comprises a frame 73 to which mesh 75 is attached. The frame 73 is mounted between vertical mesh supports 51 and, at its bottom corners 77 is pivotably connected by pins 79 to supports 51. Suitable locking means (not shown) can be provided to retain wall portion 71 in a locked, vertical position and movement limiting means 81 in the form of a chain for example, can limit the amount that the wall portion 71 swings open.

While a rack 1 has been described as equipped with a set of posts and cross-pieces, and, if desired, with another set of sidewalls and endwalls, with both being interchangeable, it is to be understood that a rack can also be provided with only a set of the sidewalls and endwalls described. In this and also in the previous case, a separate floorboard (not shown) could be provided to rest on supports 11 in the base 3 so as to retain smaller articles in the bin rack.

I claim:

1. A carrying rack comprising:

a quadrangular support base, said base having a vertical support leg at each corner thereof, each of said support legs projecting downwardly beneath said support base and having an upwardly opening socket therein;

a one-piece vertical support post for each corner, the lower end of each support post being slidably insertable into and removable from the upwardly opening socket of its associated support leg, said lower end of said post and said upwardly opening socket being arranged so that when said lower end is inserted into said socket said one-piece support post will be supported on said base in a vertical position;

at least two cross-pieces having lengths to extend between the vertical support posts on two opposite ends of the support base, one of said cross-pieces being detachably receivable on and slidable along two of the posts on one end of said base, while the other of said cross-pieces is detachably receivable on and slidable along the two posts on the other end of said base, said cross-pieces having ring means on each end thereof adaptable to be received over the upper ends of said vertical support posts on said end of said support base and to be slidable downwardly on said support posts, said ring means each encircling their respective support posts whereby said cross-pieces are connected thereto, wherein each of said downwardly projecting support legs has a socket in the base thereof, adapted to receive the top of a support post of another rack stacked therebeneath;

side wall panel means connected to extend between the pair of support posts positioned at each side of said support base, said side wall panel means being positioned downwardly from the upper ends of their respective support posts so that said ring means of said cross-pieces can be received on and can be moved downwardly on said upper ends;

end panel means carried by each cross-piece, and depending downwardly therefrom; and means on the lower edge of each end wall panel means engageable with said base for connecting said end wall panel means thereto as the cross-piece associated with said end wall panel means is moved downwardly on its associated support posts.

2. A carrying rack as claimed in claim 1, wherein each of said support posts and each of said upwardly opening sockets has a rectangular cross-section, and wherein said ring means comprise rectangular rings slidable on said support posts.

3. A carrying rack as claimed in claim 1, wherein at least one of the end or side wall panel means has a hinged portion.

4. A carrying rack, comprising:

a quadrangular support base, said base having a vertical support leg at each corner thereof, each of said support legs projecting downwardly beneath said support base, and having an upwardly opening rectangular socket therein;

a one-piece rectangular, vertical support post for each corner, the lower end of each rectangular support post being slidable insertable into and removable from the upwardly opening rectangular socket of its associated support leg, said lower end of said post and said upwardly opening socket being arranged so that when said lower end is inserted into said socket said one-piece support post will be supported on said base in a vertical position;

a pair of cross pieces, each having a length to extend between the vertical support posts on the ends of said support base, and each cross piece having a rectangular ring on each end thereof adaptable to be received over the upper ends of its associated vertical support posts and slidable downwardly thereon, said rectangular rings encircling their associated posts;

a side wall panel connected to extend between the pair of support posts positioned at each side of said support base, said side wall panels being positioned downwardly from the upper ends of their respective support posts so that said rectangular rings of said cross pieces can be received on and can be moved downwardly on said upper ends;

an end wall panel carried by each cross piece between said rectangular rings thereon, and arranged to depend downwardly from its associated cross piece toward said support base, said support base including a horizontally extending member on each end thereof;

at least one downwardly facing, generally U-shaped bracket mounted on the lower end of each end wall panel, and adapted to engage the horizontally extending support base member associated therewith as its associated end wall panel and cross piece are moved downwardly on said support posts; and each of said downwardly projecting support legs having a socket in the base thereof, adapted to receive the top of a support post of another rack stacked therebeneath.

* * * * *